US011787517B2

(12) United States Patent
Rudofsky

(10) Patent No.: US 11,787,517 B2
(45) Date of Patent: Oct. 17, 2023

(54) MAN OVERBOARD (MOB)—COMPACT POWERED RESCUE APPARATUS (CPRA)

(71) Applicant: Keith Maximilian Rudofsky, Fort Lauderdale, FL (US)

(72) Inventor: Keith Maximilian Rudofsky, Fort Lauderdale, FL (US)

( * ) Notice: Subject to any disclaimer, the term of this patent is extended or adjusted under 35 U.S.C. 154(b) by 6 days.

(21) Appl. No.: 17/220,934

(22) Filed: Apr. 2, 2021

(65) Prior Publication Data

US 2021/0347453 A1 Nov. 11, 2021

Related U.S. Application Data

(60) Provisional application No. 63/005,207, filed on Apr. 3, 2020.

(51) Int. Cl.

| | |
|---|---|
| ***B63C 9/04*** | (2006.01) |
| ***B63H 11/12*** | (2006.01) |
| ***B63B 7/08*** | (2020.01) |
| ***B63B 34/52*** | (2020.01) |
| ***B63B 1/12*** | (2006.01) |
| ***B63B 34/10*** | (2020.01) |
| ***B63B 34/56*** | (2020.01) |

(52) U.S. Cl.

CPC ..... *B63C 9/04* (2013.01); *B63B 1/125* (2013.01); *B63B 7/082* (2013.01); *B63B 34/10* (2020.02); *B63B 34/52* (2020.02); *B63B 34/56* (2020.02); *B63H 11/12* (2013.01); *B63C 2009/042* (2013.01)

(58) Field of Classification Search

CPC ..... B63C 9/04; B63B 34/56; B63B 34/52; B63B 34/10

See application file for complete search history.

(56) References Cited

U.S. PATENT DOCUMENTS 2,776,443 A * 1/1957 Howard ..... B63B 34/63 440/87
3,144,849 A * 8/1964 Maser ..... B63B 32/10 114/55.54

(Continued)

FOREIGN PATENT DOCUMENTS

CN 111252213 A * 6/2020 ..... B63B 34/10

*Primary Examiner* — S. Joseph Morano
*Assistant Examiner* — Jovon E Hayes

(57) ABSTRACT

Water rescue of an individual whether they be a man overboard (MOB) from a boat or someone close to shore requiring a water rescue by shore lifeguards, can easily become a dangerous and life-threatening situation within a few seconds.

The current invention offers a Compact Powered Rescue Apparatus (CPRA), a lightweight and compact powered watercraft that can be deployed from a moving boat in just seconds thanks to an innovative $CO_2$ inflation system. CPRA can be stowed on-board a vessel and automatically inflated in just seconds much like the compulsory life-raft or pre-inflated and ready to deploy immediately from shoreline lifeguard stations.

CPRA is a powered watercraft based on U.S. Pat. No. 5,643,029 Motorized Surf Boots (Powered Waterskis), a recreational watercraft. However, in this case the craft is made inflatable, configured with a portable stretcher for water search-and-rescue operations, and driven by battery powered electric marine thrusters.

8 Claims, 3 Drawing Sheets

(56) References Cited

U.S. PATENT DOCUMENTS 3,635,188 A * 1/1972 Rutkowski ..... A63B 35/12 440/6
5,593,334 A * 1/1997 Thayer ..... B63B 34/56 441/76
5,601,461 A * 2/1997 Mills ..... B63B 34/05 114/345
5,643,029 A * 7/1997 Rudofsky ..... B63B 34/10 441/76
D416,535 S 11/1999 Rudofsky
D424,503 S 5/2000 Rudofsky
6,155,899 A * 12/2000 Boddy ..... B63B 34/52 441/130
6,546,885 B1 * 4/2003 Francke ..... B63H 9/04 114/61.15
6,823,813 B2 * 11/2004 Mazin ..... B63C 11/46 440/6
7,121,910 B2 * 10/2006 Rosen ..... B63B 34/56 441/76
8,075,358 B2 * 12/2011 Yesil ..... B63C 9/21 441/76
8,690,617 B2 * 4/2014 Langenfeld ..... B63B 1/30 441/60
9,145,206 B1 * 9/2015 Robinson ..... B63H 21/22
9,540,090 B2 * 1/2017 Fenu ..... H04B 10/80
9,706,828 B2 * 7/2017 Nakamoto ..... B63C 9/155
10,071,289 B1 * 9/2018 Robinson ..... A63C 11/10
10,398,940 B2 * 9/2019 Grosse Austing ..... B63C 11/46
10,702,746 B2 * 7/2020 Park ..... A41D 13/0125
11,345,453 B2 * 5/2022 Robinson ..... B63H 19/00
2009/0145345 A1 * 6/2009 Newcomb ..... B63B 7/082 114/248
2010/0041285 A1 * 2/2010 Riggs ..... B63B 35/00 440/6
2010/0095877 A1 * 4/2010 Scadden ..... B63B 7/085 114/61.25
2011/0159754 A1 * 6/2011 Stone ..... B63B 32/35 441/68
2011/0174209 A1 * 7/2011 Thiessen ..... B63C 11/46 114/315
2019/0001190 A1 * 1/2019 Robinson ..... B63C 9/23
2020/0238137 A1 * 7/2020 Robinson ..... B63B 32/10
2021/0031578 A1 * 2/2021 Camarena-Vazquez ..... B63C 9/04
2021/0347453 A1 * 11/2021 Rudofsky ..... B63B 1/125
2022/0054895 A1 * 2/2022 Robinson ..... B63C 9/23

* cited by examiner

MAN OVERBOARD (MOB)—COMPACT POWERED RESCUE APPARATUS (CPRA)

BACKGROUND OF THE INVENTION

One of the most dangerous and life-threatening situations for boaters is the Man Overboard (MOB). Whether someone falls from a motorboat or a sailboat, or someone close to shore requires a water rescue by shore lifeguards, it can within seconds become a desperate situation for persons young or old, male or female. If the MOB or helpless swimmer is injured or even worse, unconscious, it is always an extremely difficult operation to retrieve them from the water without adding additional injury.

To aid in retrieving an MOB, the mandatory equipment that is carried on-board sail and motorboats consists primarily of a life ring or small floating buoy, either loose, or attached to a length of line or rope that is tied to the vessel, that can be tossed overboard to hopefully reach and provide flotation and retrieval of the MOB. However, these devices may only work for a conscious and uninjured MOB.

To provide retrieval for an unconscious or injured MOB, the quickest option, since time is of the essence, may be for other persons on-board to voluntarily jump overboard, swim to the MOB, and try to bring the MOB back to the boat. If the water is deathly cold, this may be impossible without the rescuer having first donned a proper diving suit, which will then consume even more precious time. Even with additional persons in the water trying to help, it still remains a very difficult operation to manipulate an unconscious or injured MOB out of the water and onto a boat, especially when there are waves or choppiness in the water.

In shoreline water rescue attempts, jet skis are typically positioned at lifeguard stations. However, deploying these jet skis may take over 20 seconds or longer to deploy due to the approximate 600 lbs. weight of sit-down type personal watercraft. Also, just like a boat, if someone is injured or unconscious, it still may be very difficult and perhaps impossible to gather a helpless drowning victim up and onto a personal watercraft. Even worse, either the rescuer or the person being rescued may even overturn the jet ski while trying, thus injuring both persons. Lifeguard's using jet skis for water rescue sometimes tow a floating mattress to use as a platform to perform a water rescue. Although here again, if the drowning victim is injured, it may be quite difficult to lift them up and onto the floating mattress.

BRIEF SUMMARY OF THE INVENTION

It is an object of the current invention to provide a Compact Powered Rescue Apparatus (CPRA), that can be stowed on-board a vessel, much like the compulsory Life-Raft. The CPRA is a powered watercraft based on the U.S. Pat. No. 5,643,029 Motorized Surf Boots. However, as a new utility, the original recreational watercraft is transformed into a water rescue and lifesaving watercraft instead.

Some of the valuable features of the new utility include a portable stretcher, where the two poles or rails of a typical stretcher are suspended between the boards or hulls described in motorized surf boots patent, with a long piece of canvas or other suitable waterproof mesh material slung between them and partially submerged in the water. With the material of the stretcher partially submerged, this id the rescuer in not having to lift entirely out of the water or move around too much an injured casualty. In a water rescue operation, the rescuer will slowly guide the powered CPRA craft so that it straddles over the casualty, so that the casualty would be captured between the two buoyant skis, positioning the casualty directly underneath the rescuer, between the rescuer's legs. Then the rescuer will then immobilize the casualty by pulling up draw strings along the stretcher material that will elevate the head or other parts of the body as required. Body belts and other straps are included to fully immobilize the rescued individual in order to proceed with transporting them to safety. The arrangement of the rescuer and the immobilized casualty on the CPRA is such that the rescuer while in the correct riding position, will be positioned directly above the casualty, so that CPR or other medical treatments can be administered immediately, and in an effective manner. While the casualty is immobilized and perhaps being treated, the rescuer may then continue to control the CPRA as a powered transport craft and make way to safety, to the end that precious seconds are saved, potentially saving the victim's life.

Another valuable feature of the present CPRA invention is that it folds up into a compact configuration, is made from strong and lightweight materials, and with an innovative $CO_2$ inflation system can be quickly inflated and deployed within seconds from a moving boat or from shoreline lifeguard stations. From a stowed position at the transom of a boat, when needed, the CPRA can be dropped into the water as quickly as a life ring. Thanks to an innovative $CO_2$ inflation system CPRA can be deployed, automatically inflated, and ready to ride in just a few seconds. Dropping the CPRA overboard will automatically pull on a lanyard which actuates $CO_2$ inflation similar in operation to a typical inflatable life raft. Alternatively, the inflation system can be activated manually by pushing on dedicated buttons on each ski that directly actuates the $CO_2$ cylinder inflation valves. Once the pair of skis are inflated and buoyant within a few seconds, the rescuer/rider can then mount the craft, remove the tether line or rope from the boat's cleat and begin to make way for the MOB.

Thanks to its lightweight and portability beach lifeguards responding to a need to perform a water rescue will be able to deploy a CPRA in less time than it takes to deploy a typical jet ski which is commonly used today. A typical jet ski may take about 18 seconds or more to deploy, whereas the time to deploy the present CPRA invention could be less than 8 seconds. The time savings would be primarily due to the CPRA being a more lightweight craft, therefore not requiring the same amount of physical effort as compared to a jet ski in order to launch the watercraft from a sandy beach or other standby location.

Another novel feature of the present CPRA invention includes propelling the apparatus by a pair of battery powered electric marine thrusters, one fitted within each buoyant ski. Further assembled to each ski are D416,535 Propeller Shroud Defining Waterflow Ducts, and D424,503 Propeller Guard having Maneuvering Vanes, both previously issued USPTO design patents, which, when assembled together within the buoyant skis form a waterjet duct that totally encloses the propeller, thus providing a barrier of protection to prevent someone from accidently touching the propeller during operation.

BRIEF DESCRIPTION OF THE SEVERAL VIEWS OF THE DRAWING

The features of the present CPRA invention will be more clearly understood from consideration of the following description taken in connection with the accompanying drawings, in which.

DETAILED DESCRIPTION OF THE INVENTION

Figure 1:
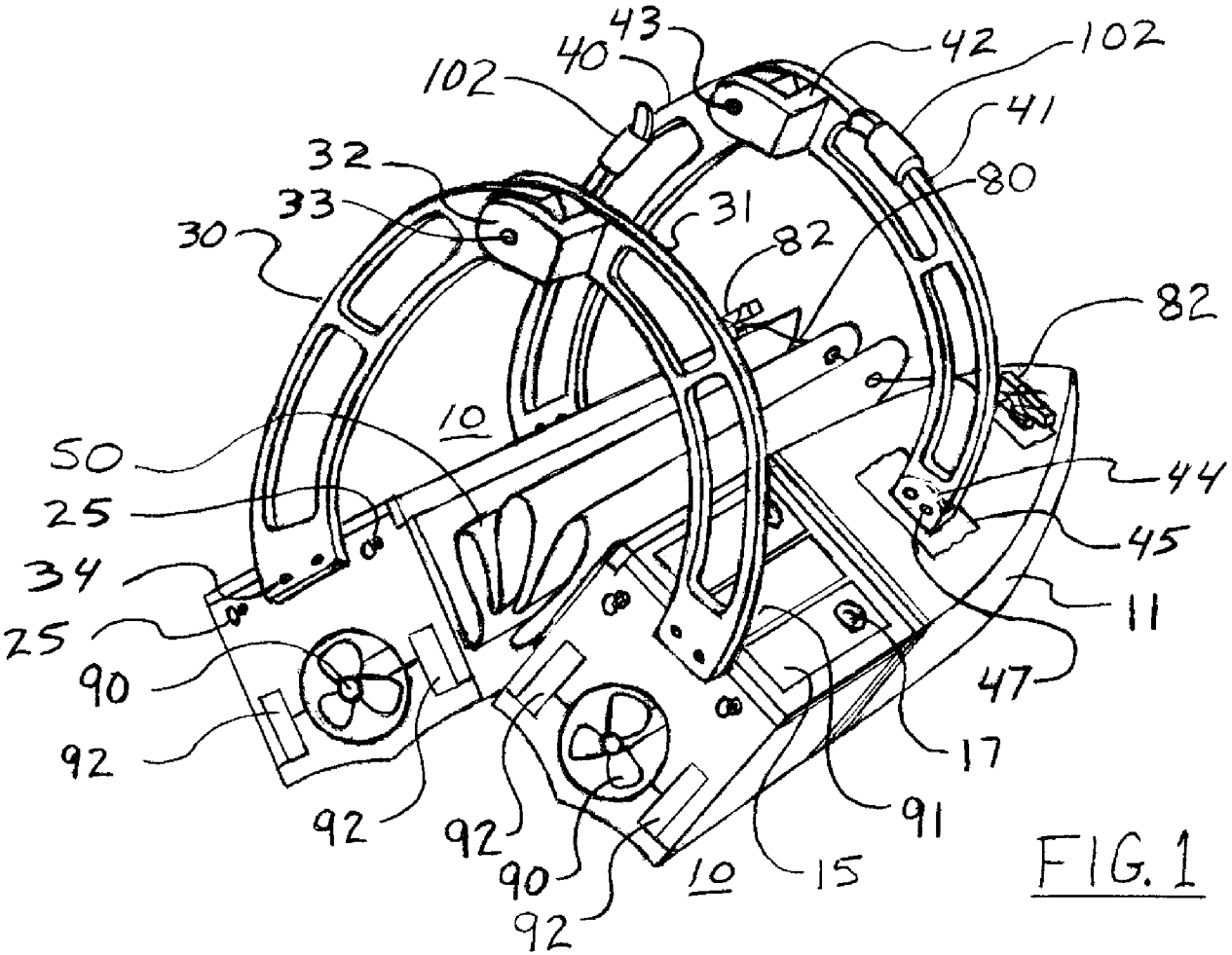
FIG. 1 is a rear isometric view of the present CPRA invention shown folded-up and un-inflated as would be in the stowed configuration.
Figure 2:
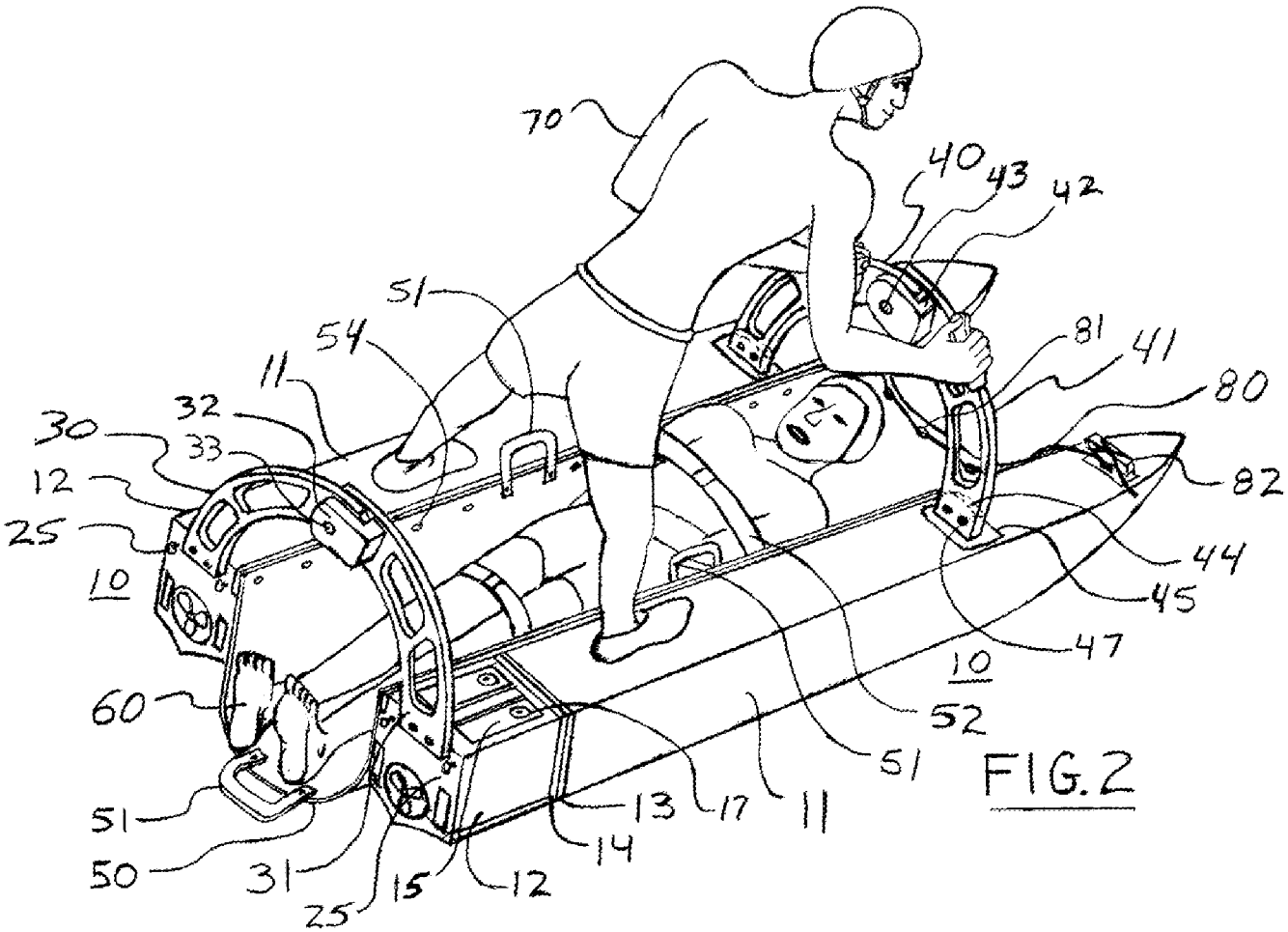
FIG. 2 is a rear isometric view of the present CPRA invention shown in the deployed and inflated configuration with both the rescuer/rider on-board and a casualty immobilized in the stretcher below.
Figure 3:
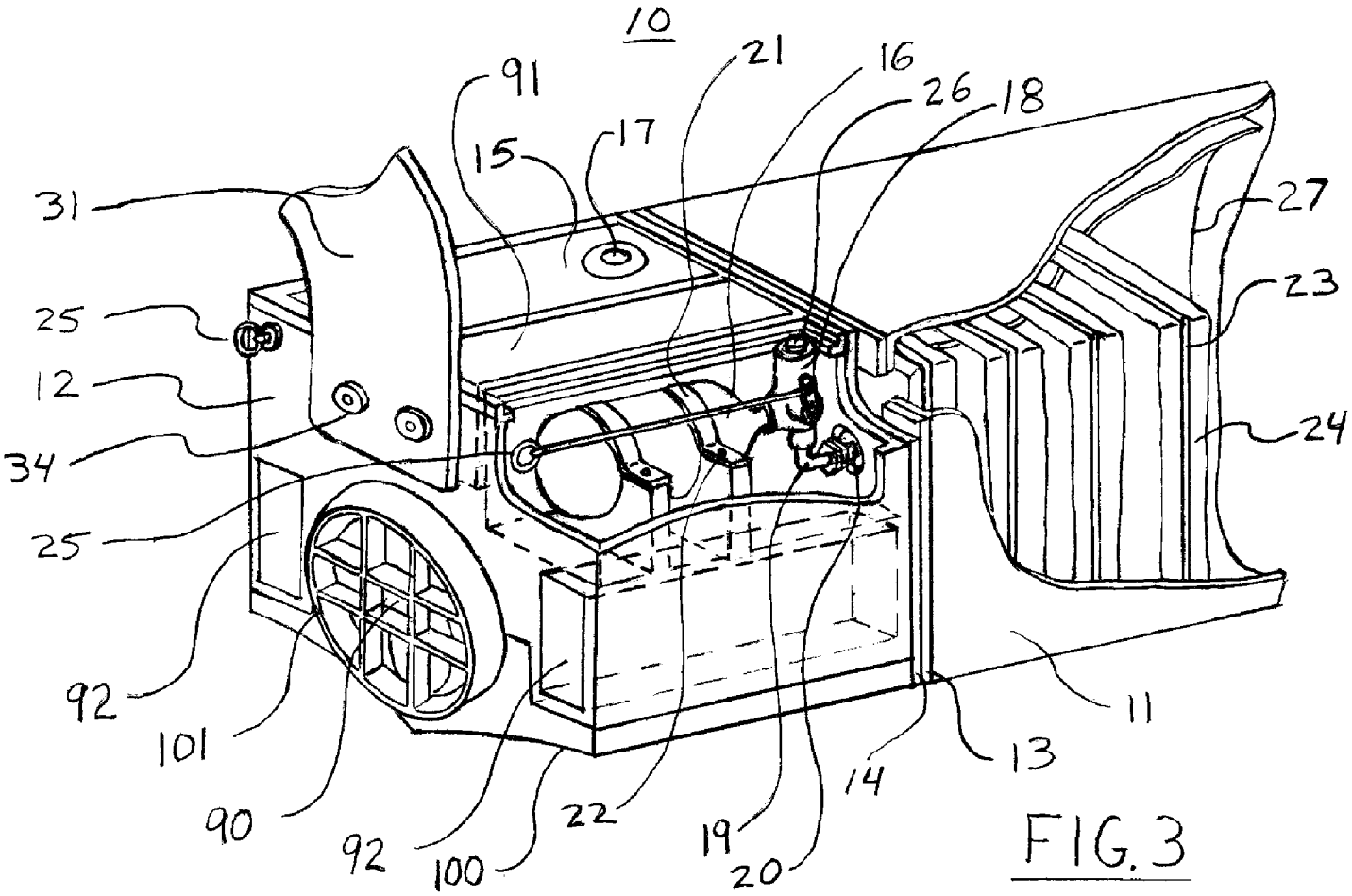
FIG. 3 is a rear isometric view of one of the buoyant skis of the present CPRA invention, showing a cut-away view of the inflation system and hidden lines representing the compartments for the propulsion system components as described further herein.

In the embodiment of a Compact Powered Rescue Apparatus (CPRA) shown in FIGS. 1, 2, and 3, and in particular to FIG. 3, each of the boards originally discussed in the prior art of U.S. Pat. No. 5,643,029 continue to be shown as reference numeral 10, however are now each arranged in sub-parts including first, a flexible outer skin material 11 which is made from any suitable material such as canvas, rubber, plastic or other compound. The outer skin 11 material may or may not be airtight. If not airtight then alternatively an Inner Bladder 27 can be inserted inside the Outer Skin 11 to perform as the inflatable medium. The rear facing end of the Outer Skin 11 is initially open, yet bonded to a rigid Frame 13, which acts as a rim for the open side of Outer Skin 11. The function of Frame 13 is to keep the ski cross-sectional shape defined in this area for the Outer Skin 11 while also providing an aperture to access the inside of it, as would be required for its construction. For inside the Outer Skin 11 are spaced numerous Rigid Battens 23 which are spaced parallel to each other and held in place by strips of Flexible Material 24, which are bonded to the inside walls of the Outer Skin 11. The Battens 23 act as a skeleton for the Outer Skin 11, which when inflated will take on a predetermined hull-like or fattened ski shape. When the Outer Skin 11 is not inflated, it can be compressed accordion style, allowing for a small compact shape for storage in confined areas as shown in FIG. 1. Continuing with the details shown in FIG. 3, Frame 13 is mated to a rigid and solid Plate 14 which acts to close off the Outer Skin 11 completely. Plate 14 is attached to Frame 13 by any appropriate method which may include gluing, screwing, or latching. Attached rearward of Plate 14 is a rigid Housing 12 which provides a rearward extension of the hull-like shape of the buoyant ski 10, and also provides the internal spatial volumes and compartments for the packaging arrangement of the inflation components and the propulsion components. The attachment of Plate 14 to Housing 12 can also be by gluing, screwing or latching as desired.

Also seen in FIG. 3, in order to inflate the Outer Skin 11 or alternatively an inner Bladder 27, commonly used $CO_2$ Cartridges 16 can be packaged symmetrically within housing 12 seen in FIG. 3 with one shown in the cutaway portion of the view and the other in a symmetric position hidden under the watertight Top Cover 15. For each $CO_2$ cartridge 16 a commonly used $CO_2$ Release Valve 18 is fitted that includes a lanyard pull cable with pull ring 25 and also a manual push button 26. Similar to that used to fill bicycle tires, the $CO_2$ Release Valve 18 also includes a free spinning valve stem connection, which is then screwed onto Tubing Fitting 19 and further connected to Valve Nipple 20 which is then screwed into Plate 14, thus providing the filling port into the closed Outer Skin 11. Alternatively, the Valve Nipple 20 can be part of Inner Bladder 27 and be simply inserted through Plate 14 and connected to Tubing Fitting 19. The two methods previously considered for inflation of the Ski is similar in nature to deciding whether to choose tubeless tires or tires that have an inner tube, both having pros and cons with regard fit, form and function.

The CO2 Cartridge(s) 16 are held in place by Straps 21, of which are attached by any appropriate Hardware 22. A watertight Top Cover 15 is then assembled which includes a Flexible Element 17 that allows the push button 26 of the CO2 Cartridge Valve 18 to be actuated externally. The lanyard pull cable with pull ring 25 extends through the rearward side of the Housing 12, so that the user can attach to the ring any length of additional tether line or rope required for aligning the proper deployment position for the CPRA from a stowed position on the stern or transom of a boat. This line or rope would be cleated to the aft of the boat, in order that once the CPRA is deployed and inflated, and the rider jumps onboard, the CPRA can be manually uncleated from the boat and the rider could begin to accelerate away from the boat towards the MOB.

The propulsion components also packaged within Housing 12 includes a commonly used Electric Marine Thruster 90 and its typically related components including an Electronic PC Board and electronics components, which are located in Compartment 91, and Batteries which are located in Compartments 92. In order to enclose the marine thruster 90 so that no person inadvertently touches the propeller, USPTO design patent D416,535 Propeller Shroud Defining Waterflow Ducts shown as numeral 100, and D424,503 Propeller Guard having Maneuvering Vanes shown as numeral 101 are utilized.

As shown in FIG. 1, the controls 102 to regulate the pair of marine thrusters will be similar to invention U.S. Pat. No. 5,643,029 Motorized Surf Boots, in the form of hand or thumb operated controls, one for each board 10. Alternatively, in the present invention the hand operated thrust controls 102 may also be of the wireless type which has become commonplace, in that physical cables are not required. Thus, the thruster controls can be attached to connecting arms 40 and 41 which are further discussed below.

Thus, a pair of boards or buoyant skis each consisting of the novel component arrangement detailed above are then connected together with two sets of rigid Connecting Arms as shown in FIG. 1-2; a forward set of Connecting Arms 40 and 41 and a rearward set of Connecting Arms 30 and 31. Arms 40 and 41 are held together by a Clevis or Link 42 and allowed to rotate on a Pin or Bolt 43. The lower end of each of the Arms 40 and 41 are connected to the top surface of each ski by Pins or Bolts 47 that pass through a Mount 44 fastened to the top of each ski 10 by any appropriate manner such as glue or screws or by use of another intermediate part such as a Base Patch 45, that is then sewed and bonded to Outer Skin 11. Arms 40 and 41 will also include hand grab features for the rider to hold onto as well as the Thruster Control Levers 102. In a similar fashion the rear set of connecting links includes Arms 30 and 31 held together by a Clevis or Link 32 and allowed to rotate on a Pin or Bolt 33. Each of the Arms 30 and 31 are attached to their respective Housing 12 by any appropriate attachment hardware 32. Both the forward set of Connecting Arms 40 and 41 and rear set 30 and 31 are such that when they fold, they allow the pair of Boards 10 to fold together into a compact arrangement for storage. When the Water Rescue is required, both sets of Connecting Arms are spread open to a predetermined shape and locked into position either manually, or automatically by use of any commonly used cam, spring, or latch mechanism.

Further, as shown in FIG. 1-2, a Mesh Sling 50, acting as a portable stretcher, is attached to the inside surface each of the Buoyant Skis 10, by the use of any number of Snaps or Eyelets 54 that can be easily connected or disconnected. Thus, when the CPRA is deployed for use, the Sling 50 is suspended just under the surface of the water. Once a Rescued Person 60 is positioned within the Sling 50, the forward portion of the Sling 50 can be raised out of the water by pulling tight the Draw Lines 80 that attach to an eyelet 81 near the leading edge of the Sling 50 and cleating the Draw Lines 80 to a Cleat 82, which is bonded to the forward portion of Buoyant Ski 10. Thus, by raising the forward portion of the Mesh Sling 50, the Rescued Person's 60 head and upper body can be raised above the water line. The Sling 50 includes any number of Grab Handles 51 for lifting, and any number of Straps or Belts 52 for securing the Rescued Person 60 in place.

Once the Rescuer 70 has retrieved and secured the Rescued Person 60, into the Sling 50, with the Straps 52, he or she can proceed to navigate to a safe harbor as depicted in FIG. 2. Alternatively, the Rescuer 70 can power the CPRA back to a boat and then disconnect the Sling 50 with the strapped-in Casualty 60 from the CPRA, to be lifted onboard the vessel or air lifted up and into a helicopter.

While there have been described what are considered to be a preferred embodiment of the invention described herein, it will be readily appreciated by those skilled in the art that modifications can be made without deviating from the scope of the teachings herein. For at least such reason therefore, resort should be had to the claims appended hereto for a true understanding of the scope of the invention.

I claim:

1. A compact powered rescue apparatus for transporting a driver of the compact powered rescue apparatus and a casualty comprising:

a flexible material attached between a first buoyant motorized ski and a second buoyant motorized ski, the flexible material positioned such that the casualty is able to be immobilized while being carried between the first buoyant motorized ski and the second buoyant motorized ski; and wherein the first buoyant motorized ski is connected to the second buoyant motorized ski by a first connecting arm and a second connecting arm.

2. The apparatus of claim 1, further comprising a gas inflation system.

3. The apparatus of claim 2, wherein the gas inflation system is powered by a cartridge.

4. Thai apparatus of claim 3, wherein the gas is CO2.

5. The apparatus of claim 1, further comprising an inner bladder positioned in the first buoyant motorized ski and the second motorized ski.

6. The apparatus of claim 1, wherein the first motorized ski and the second motorized ski include at least one: electric marine thruster, electronic control board, and battery operably connected to provide thrust to the first motorized ski and the second motorized ski.

7. The apparatus of claim 1, wherein the first connecting arm and the second connecting arm fold.

8. The apparatus of claim 4, wherein the gas is automatically released by a lanyard pull.

* * * * *